United States Patent [19]

Arieh et al.

[11] Patent Number: 4,660,302

[45] Date of Patent: Apr. 28, 1987

[54] SKI BOOT

[75] Inventors: Simon Arieh; Guy Courvoisier, both of Geneva, Switzerland

[73] Assignee: Lange International S.A., Fribourg, Switzerland

[21] Appl. No.: 835,056

[22] Filed: Feb. 28, 1986

[30] Foreign Application Priority Data

Mar. 7, 1985 [CH] Switzerland ..... 1037/85

[51] Int. Cl.[4] ..... A43B 5/04; A43B 11/00

[52] U.S. Cl. ..... 36/117; 36/50; 24/68 SK; 24/70 SK; 24/274 R

[58] Field of Search ..... 36/117–121, 36/50; 24/68 SK, 69 SK, 70 SK, 71 SK, 274 R, 280, 20 TT

[56] References Cited

U.S. PATENT DOCUMENTS 3,214,809 11/1965 Edwards ..... 24/68 B
3,668,791 6/1972 Salzman et al. ..... 36/50
3,729,779 5/1973 Porth ..... 24/68 SK
4,547,980 10/1985 Olivieri ..... 36/50
4,565,017 1/1986 Ottieri ..... 36/117
4,614,047 9/1986 Arieh et al. ..... 36/50

FOREIGN PATENT DOCUMENTS 0073989 3/1983 European Pat. Off. ..... 36/117

*Primary Examiner*—James Kee Chi
*Attorney, Agent, or Firm*—Brumbaugh, Graves, Donohue & Raymond

[57] ABSTRACT

This ski boot comprises a fastening and tension device consisting of a cogged strap of which the teeth are cycloidal segments parallel to the strap plane. These teeth cooperate with drive studs carried by a rotary disc coupled to a control knob. The studs are disposed at spaced angular intervals on a circumference so that they describe cycloids corresponding to the teeth with respect to the strap.

5 Claims, 7 Drawing Figures

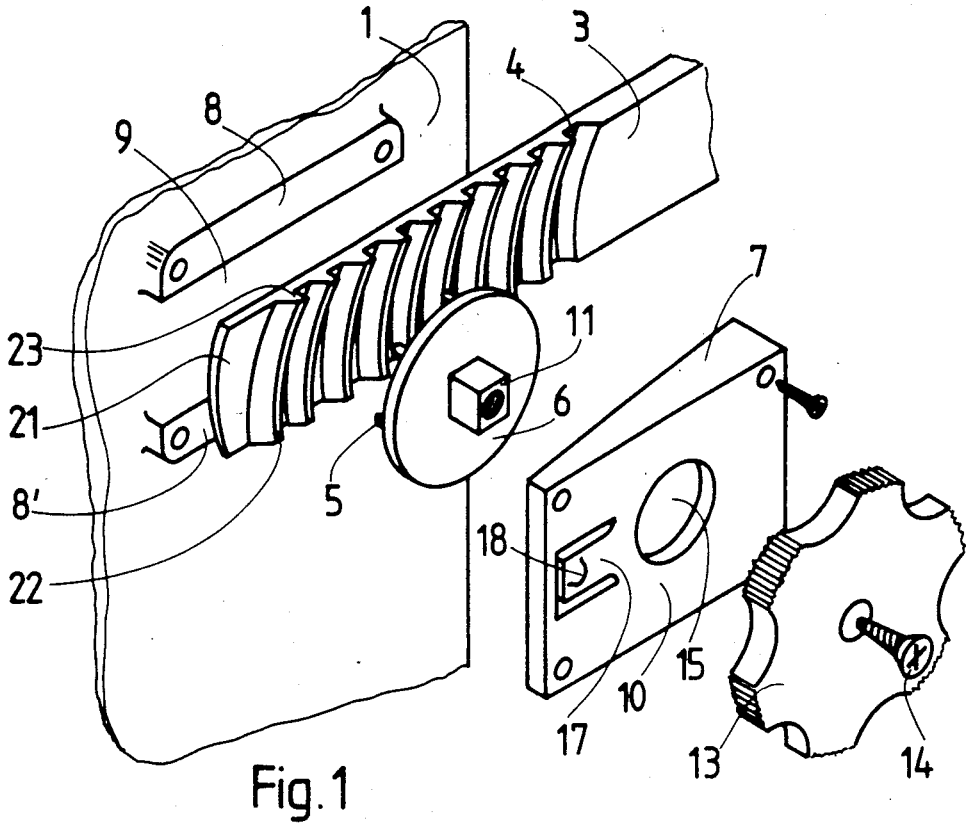
Fig. 1
Fig. 2
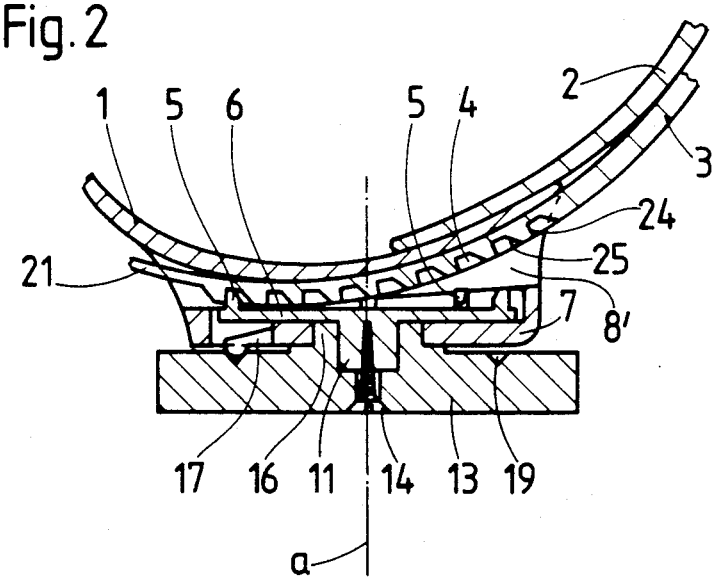

SKI BOOT

BACKGROUND OF THE INVENTION

The present invention relates to ski boots and has specific reference to an improved ski boot comprising at least two main portions having overlapping edges for surrounding the foot or ankle and at least one closing and tension device for interconnecting these portions, this device comprising a toothed strap fixed to one of said boot portions and adapted to cooperate with hooking and tension means carried by the same or the other portion of the boot.

THE PRIOR ART

A device of this character is known through the U.S. Pat. No. 3,662,435. In this prior art device the strap is toothed and cooperates on the one hand with tension means comprising a unidirectional drive member movable to-and-fro and on the other hand with a retaining pawl, this assembly operating somewhat in the fashion of a rack-jack. A device of the same type is also known from the German Pat. No. DE-A-33.17.359. These prior art devices are relatively complicated and cumbersome, and in many cases their operation is attended by various difficulties. In fact, to release the strap it is necessary to free the retaining pawl, and this movement may require a considerable effort when the strap is tightly tensioned. Moreover, the tension can only be changed by reason of one tooth at one and the same time, and the teeth must have a predetemined minimum size to warrant a reliable locking action. Moreover, the tension lever provides only a reduced leverage and therefore its actuation becomes rather difficult beyond a certain tension. Finally, the tension can only be adjusted by tightening, not by releasing the device.

It is the primary object of the present invention to provide a compact fastening and tension device which can be easily operated even under a relatively high tension while affording a continuous adjustment in both tightening and release directions. In fact, a fine adjustment is particularly sought by a skier having overtightened his boots or who is simply desirous to reduce the pressure exerted on his foot without having to open the boot for this purpose.

The improved ski boot according to this invention is characterized by the fact that the cogged strap having elongated cycloidal teeth formed on one side which are generated in the strap plane by points disposed at spaced intervals on a circumference surrounding exernally the rolling circumference on which the cycloid is generated, and that the hooking and tension means consist of a rotary disc provided with studs disposed at spaced angular intervals on a circumference concentric to the axis of rotation of the disc and having a diameter greater than the strap width, said circumference and said studs corresponding to said external circumference on which the cycloid is generated for obtaining said cycloidal teeth, said disc being rotatably mounted to said strap for rotation about an axis extending askew with respect to the strap, whereby said disc is inclined with respect to the strap in the longitudinal direction of the strap, means being provided on the toothed strap for guiding the strap with respect to the disc and keeping the strap teeth in meshing engagement with the disc studs, and arrangement being such that when the studs are driven for rotation by the strap teeth they engage the strap teeth only from the disc side or half nearest to the strap.

The use of a cogged strap having cycloidal teeth of the above-defined type and driven by studs afforeds a greater leverage to increase the force facilitating the stretching and the quick movements of the strap. The device of the present invention is particularly compact since its overall dimensions lie within the limits of the surface area of the control disc. The tension adjustment may be either continuous or nearly continuous in both tightening and release directions.

It is worth pointing out that as contrasted with current practice the term "cycloidal" as used in this specification does not refer to the tooth profile which may have any desired and suitable configuration.

Two specific forms of embodiment of the present invention will now be described by way of example with reference to the accompanying drawings.

THE DRAWINGS

FIG. 1 is an exploded view of the fastening and tension device according to a first form of embodiment of the invention;

FIG. 2 is a fragmentary section showing the device in its assembled condition;

DESCRIPTION OF THE PREFERRED EMBODIMENTS

Figure 3:
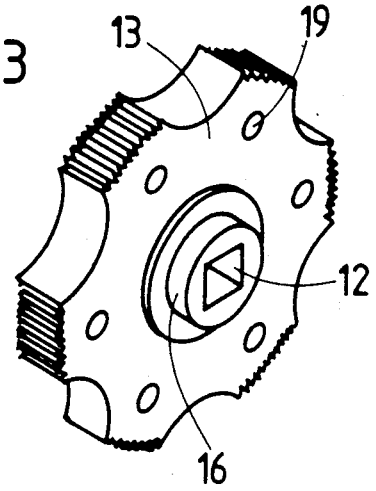
FIG. 3 is a perspective view of the back face of the control disc.
Figure 4:
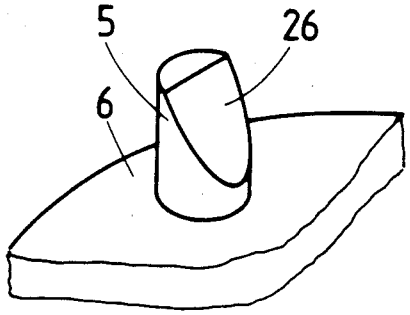
FIG. 4 is a perspective view of one of the studs carried by the front face of the control disc.
Figure 5:
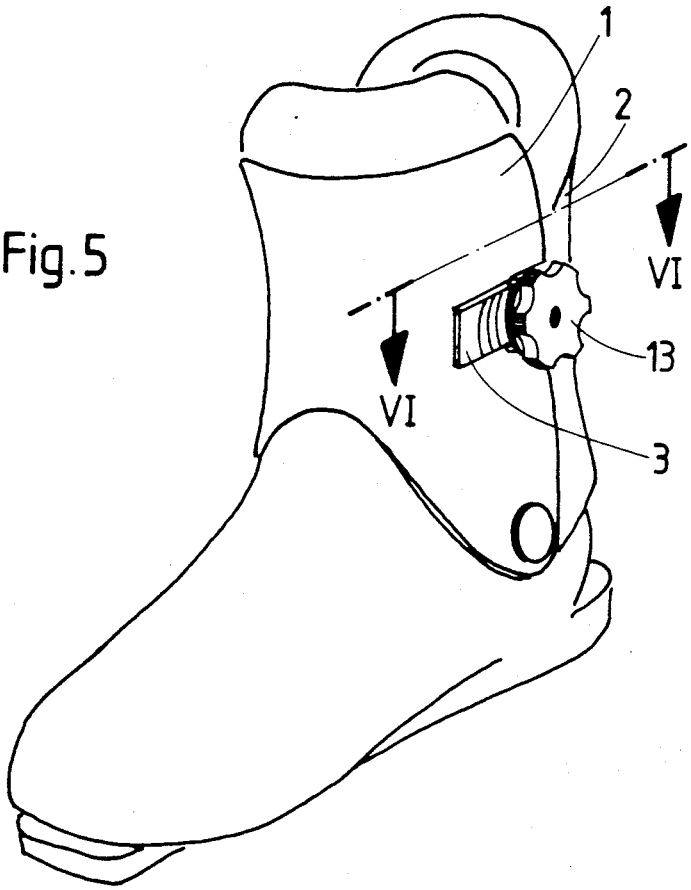
FIG. 5 is a perspective view showing the complete ski boot provided with the fastening and tension device according to a modified form of embodiment of the invention.

Referring first to FIGS. 1–4 of the drawings, two portions 1 and 2 of a ski boot, for example of the ski boot shown in FIG. 5, constitute the front quarter 1 and the rear quarter 2 of the upper of a rear-access ski boot, which are interconnected by means of a strap 3 attached to the other side of portion 1 and extend around portion 2.

This strap 3 comprises a cogged portion having cycloidal teeth 4; in other words, these teeth consist of elongated cycloidal segments generated in the plane of the strap by points disposed at spaced intervals on a circumference disposed externally of the rolling circumference generating the cycloid. The cycloid generating points correspond to nine studs 5 disposed at spaced angular intervals on the inner surface of a disc 6 adapted to rotate about an axis coincident with the axis of the cycloid generating circle.

The disc 6 is mounted to a support 7 secured in turn by means of four screws to a pair of coplanar elongated flat-faced bosses 8,8′ formed on the boot so as to provide therebetween a channel 9 for guiding the strap 3. The support 7 has an outer face 10 somewhat inclined to the surface of bosses 8,8′, that is, with respect to the strap 3. The disc 6 is provided on its outer face with a square projection 11 engageable in a corresponding square hole 12 (FIG. 3) of a rotary control knob 13 adapted to be secured to the disc 6 by means of a screw 14 extending through a circular hole 15 formed in support 7 and engageable in turn by the cylindrical hub 16 of control knob 13. The support 7 has formed integrally therein a small resilient tongue 17 provided at its outer end with a substantially semispherical boss 18. This tongue 17 acts as a detentpositioning pawl adapted to cooperate with recesses 19 formed for this purpose in the outer surface of control knob 13. The retaining force obtained with this resilient pawl 17 is easily overcome by the user and yet it is sufficient for preventing any undesired rotation of the disc 6 caused by the tension exerted on strap 3.

In either case the axis of rotation a of disc 6 is askew with respect to strap 3, considering the tangent to the point of intersection of this axis with the strap. Consequently, the disc 6 is inclined toward the end 21 of strap 3. This inclination causes the studs 5 to engage the teeth 4 only when the studs have been rotated through a circular arc located on the half-circumference disposed on the side of said strap end 21, and the same studs 5 cannot mesh with teeth 4 when they are caused to move on the other half-circumference, that is, on the right-hand side of axis a. Thus, the studs located on the right-hand side of axis a are prevented from interfering with the driving action of the studs located on the left-hand side of said axis.

The width of strap 3 and the position of said axis a with respect to the strap are so selected that the lower ends 22 of teeth 4 lie in a portion of the elongated cycloid which has already a strong inclination and that the upper ends of said teeth 23 lie at least just above the point of intersection of said elongated cycloid. Thus, the maximum benefit is derived from said cycloids and several studs 5 can mesh simultaneously with the teeth 4 and drive the strap 3.

The profile of the strap teeth 4 comprises a perpendicular face 24 at the rear and an oblique face 25 at the front (the so-called Buttress threads profile) of the strap. The studs 5 have a substantially cylindrical configuration cut slantwise to provide a face 26 directed towards the centre of the disc 6, that is, on the side of the oblique face 25 of teeth 4 when the stud 5 is in meshing engagement with the teeth 4 of strap 3. The purpose of these slanted stud faces is to facilitate the insertion of the strap 3 under the disc 6. However, this advantageous feature is more apparent in the second form of embodiment shown in FIGS. 5–7, which differs from the first form of embodiment of FIGS. 1–4 only by the mounting of the disc 6 to a movable support. Therefore, the unchanged component elements are designed by the same reference numerals as in FIGS. 1–4.

The control knob 13 and the disc 6 coupled therewith are mounted on a support 27 consisting of a U-section member pivoted at one end about a pin 28 carried by an element 29 of the front quarter 1 of the ski boot, in which a passage is formed for the strap 3. Like the plate 7 of the first form of embodiment, the support 27 has a circular hole 30 formed therethrough which is rotatably engaged by the hub 16 of control knob 13 and a pawl 31 similar to pawl 17 of the first form of embodiment. The side faces of support 27 have a hook-forming recess 32 adapted to engage a matching projection 33 of the ski boot when the support 27 is folded toward and then locked down against the boot, as shown in thick lines in FIG. 6. In this position, the U-shaped profile of support 27 acts as a means for guiding the strap and the disc 6 operates exactly as in the first form of embodiment.

Figure 6:
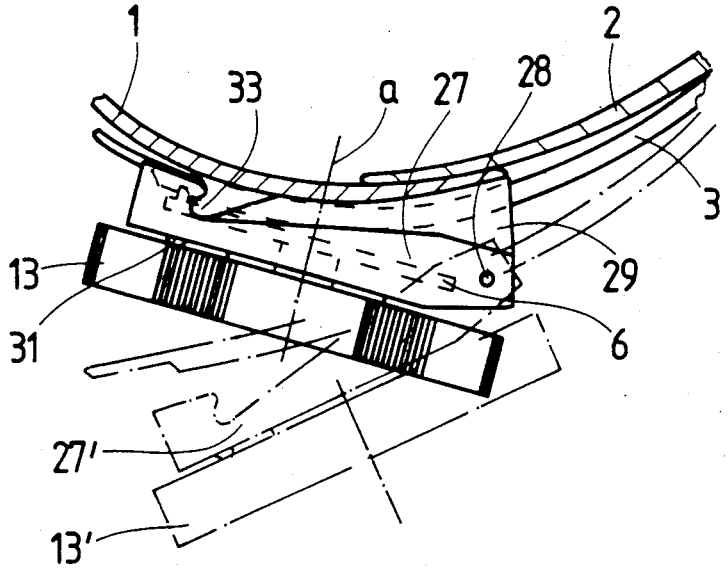
FIG. 6 is a fragmentary section taken along the line VI—VI of FIG. 5.
Figure 7:
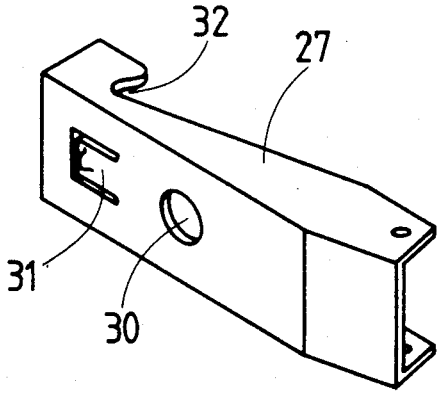
FIG. 7 is a perspective view showing the means for guiding the strap in this modified form of embodiment.

Though the use of cycloidal teeth cooperating with a plurality of drive studs affords a relatively quick movement of the strap in the fastening direction, the possibility of pivoting the support 27 away from the boot, as illustrated in chain lines in FIG. 6, permits of inserting and respectively releasing the strap still more rapidly. For this purpose it is only necessary to pull the control knob 13 by gripping the edges thereof. After a sufficient strap length has been introduced into the device, the knob 13 is folded back and then pressed to secure and lock the support 27 to projections 33. The strap can be introduced at a relatively fast rate without necessarily pivoting the support 27 completely away from the boot, since it is only necessary to unlock the support 27 to enable the strap teeth 4 to move the studs 5 away by engaging the oblique faces 25 of said studs.

The fastening and tension device may if desired be made partially of completely of synthetic materials. It is also suited for acting as an efficientt substitute for any known ski-boot fastening device or buckle.

What is claimed is:

1. A ski boot comprising at least two portions having overlapping edges for surrounding the skier's foot or ankle, and at least one fastening and tension device for interconnecting said portions, said device comprising a cogged strap attached to one of said boot portions and adapted to cooperate with means for hooking and tensioning said one portion or the other portion, wherein said cogged strap comprises cycloidal teeth consisting of elongated cycloidal segments generated in the plane of said strap by points disposed at spaced angular intervals along a circumference externally of the rolling circumference, said fastening and tension means comprising a rotary disc provided with studs disposed at spaced angular intervals along a circumference concentric to the axis of rotation of said disc and of a diameter greater than the strap width, said circumference and said studs corresponding to said external circumference for generating said cycloidal teeth on said strap, whereby said disc is inclined with respect to said strap in the direction toward the strap end, and means for guiding said cogged strap under said disc and keeping said strap in meshing engagement with the disc studs, so that when said studs are driven for rotation they engage said teeth only on the disc half nearest to the strap.

2. The ski boot of claim 1, wherein said guide means consist of a U-shaped section member pivoted to the boot so that it can be folded toward and pulled away from the strap, said disc being rotatably mounted to said section member, and said section member being provided with hook means for locking said section member in its operative position against said strap.

3. The ski boot of claim 1, wherein said disc and its support are provided with means for resiliently retaining said disc.

4. The ski boot of claim 3, wherein said means comprise on the one hand a resilient pawl cut in said disc support and on the other hand hollows formed in said disc.

5. The ski boot of claim 2, wherein said disc is slanted towards the front end of the strap and said studs and/or the strap teeth have a slanted face to permit the quick insertion of the cogged strap under the disc in the folded but unlocked position of said guide means.

* * * * *